US007244062B2

(12) United States Patent
Golay

(10) Patent No.: US 7,244,062 B2
(45) Date of Patent: Jul. 17, 2007

(54) DEVICE FOR STOPPING THE BALANCE DURING THE TIME-SETTING OF A TOURBILLON WATCH

(75) Inventor: Patrice Golay, Le Sentier (CH)

(73) Assignee: Montres Breguet SA, L'Abbaye (CH)

( * ) Notice: Subject to any disclaimer, the term of this patent is extended or adjusted under 35 U.S.C. 154(b) by 28 days.

(21) Appl. No.: 11/178,339

(22) Filed: Jul. 12, 2005

(65) Prior Publication Data

US 2006/0013072 A1 Jan. 19, 2006

(30) Foreign Application Priority Data

Jul. 13, 2004 (EP) ..... 04016411

(51) Int. Cl.

| | |
|---|---|
| ***G04B 17/28*** | (2006.01) |
| ***G04B 27/00*** | (2006.01) |
| ***G04B 27/02*** | (2006.01) |
| *G04B 33/08* | (2006.01) |

(52) U.S. Cl. ..... 368/127; 368/142; 368/145; 368/190

(58) Field of Classification Search ..... 368/76, 368/124–128, 139, 142, 144, 220, 145, 190
See application file for complete search history.

(56) References Cited

U.S. PATENT DOCUMENTS

| | | | | |
|---|---|---|---|---|
| 6,196,713 | B1 | 3/2001 | Meis et al. | |
| 6,402,368 | B1 * | 6/2002 | Grimm et al. | 368/127 |
| 6,749,333 | B2 * | 6/2004 | Scheufele | 368/127 |
| 6,846,104 | B2 * | 1/2005 | Geyer | 368/127 |
| 2004/0062149 | A1 | 4/2004 | Geyer | |
| 2004/0184356 | A1 * | 9/2004 | Dias | 368/127 |
| 2006/0181962 | A1 * | 8/2006 | Besse et al. | 368/127 |

FOREIGN PATENT DOCUMENTS

| | | |
|---|---|---|
| DE | 101 60 287 A1 | 6/2003 |
| WO | WO 03 048871 A2 | 6/2003 |

* cited by examiner

*Primary Examiner*—Vit Miska
*Assistant Examiner*—Thanh S. Phan
(74) *Attorney, Agent, or Firm*—Sughrue Mion, PLLC

(57) ABSTRACT

The stop second device during precise time-setting of a watch fitted with a tourbillon (1) comprises mobile elements such as levers (14, 15, 16) mounted in the carriage (2) of the tourbillon, each of said mobile elements being returned by a return spring (28, 29, 30). These mobile elements are capable of contacting the periphery of the balance (3) of the tourbillon, to block said balance when action is exerted on at least one of said mobile elements by a shoe (17) arranged outside the carriage (2) and controlled by the time-setting stem (26) of the watch. The outer edges (18, 19, 20) of the levers are located above pillars (4) of the carriage (2), such that the shoe (17) can act on the levers without interfering with said pillars.

8 Claims, 4 Drawing Sheets

DEVICE FOR STOPPING THE BALANCE DURING THE TIME-SETTING OF A TOURBILLON WATCH

BACKGROUND OF THE INVENTION

The present invention relates to a device for stopping the movement during time-setting of a watch fitted with a tourbillon, the tourbillon comprising a rotating carriage inside which a balance oscillates about a rotational axis of the carriage, the device comprising manually controlled means for blocking the balance in its peripheral zone.

Such a device, sometimes called a "stop-second", has already been proposed for stopping the oscillation of the balance in the tourbillon carriage when the time is being set, in any position of the carriage, from the control stem of the watch in order to start the movement at a precise moment, for example exactly at the time indicated by the hands of the watch.

There is a description of this device given in DE Patent Application No. 101 60 287 A1 repeated in International Patent Application WO 03/048871. In a manner that is well known in the state of the art, the tourbillon comprises a mobile carriage, which carries all of the escapement members and, at its centre, the regulating member comprising the balance. The escapement pinion rotates about the second wheel which is fixed. The carriage makes one revolution per minute and eliminatesrate variations by rotating when it is in vertical positions. In order to stop the movement, the aforecited document proposes a mobile spring with two elastic arms, each ending in a pad able to abut elastically against the periphery of the balance to stop it. This mobile spring is controlled by the time setting crown, which is also manually controlled.

This device has, however, several drawbacks. First of all, the mobile spring is complicated to make, since, because of its great length, it also requires an adjustment that is difficult to carry out. Another drawback lies in the fact that a spring of such length can easily be deformed via the effect of a shock applied to the watch and thus inadvertently block the balance. Finally, it will be mentioned that in top of the range horology, the use of a wire spring or strip spring is generally prohibited, as it is unattractive and offers solutions that are ill-suited to a highly technical object.

SUMMARY OF THE INVENTION

In order to overcome the aforecited drawbacks, the present invention, in addition to answering the generic definition given in the first paragraph of this description, is characterized in that the means for blocking the balance comprise mobile elements mounted on the tourbillon carriage and capable of contacting the periphery of the balance to block it when an action is exerted on at least one of the mobile elements by an element arranged outside the carriage and controlled manually.

In a preferred embodiment, each of said mobile elements is a lever the first end of which is pivotably mounted on the carriage and the second end of which carries a pad capable of locking the balance when a shoe, controlled by a time-setting stem, exerts a pressure on the lever, each of said levers being returned to a rest position by a return spring.

BRIEF DESCRIPTION OF THE DRAWINGS

Other features and advantages of the present invention will appear from the following description, in conjunction with the annexed drawings, given by way of non limiting illustration, of an advantageous embodiment of said stop device for a tourbillon watch, drawings in which.

DETAILED DESCRIPTION OF ONE EMBODIMENT

Figure 1:
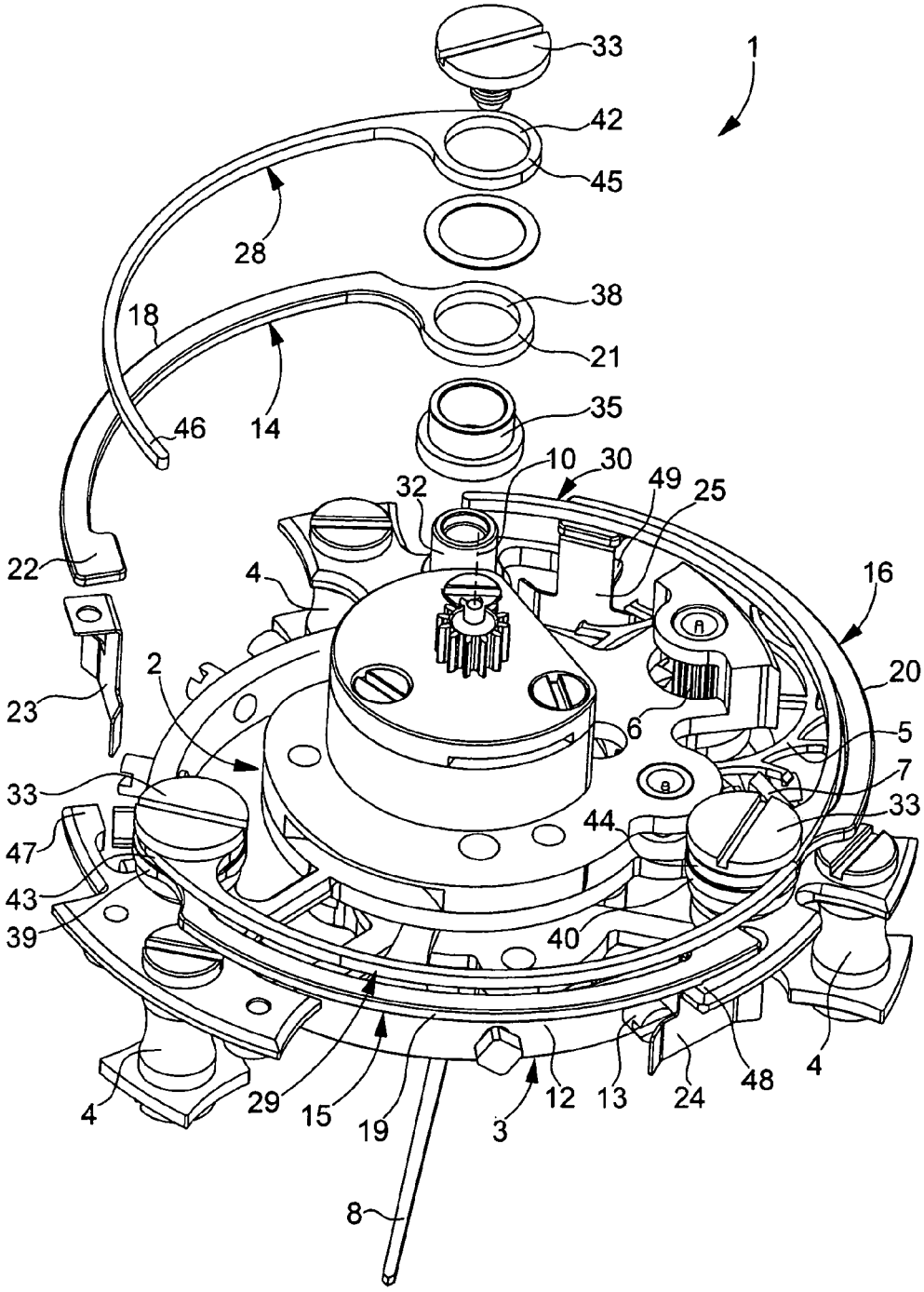
FIG. 1 is a perspective view of the tourbillon of the invention, one part of which is exploded.
Figure 2:
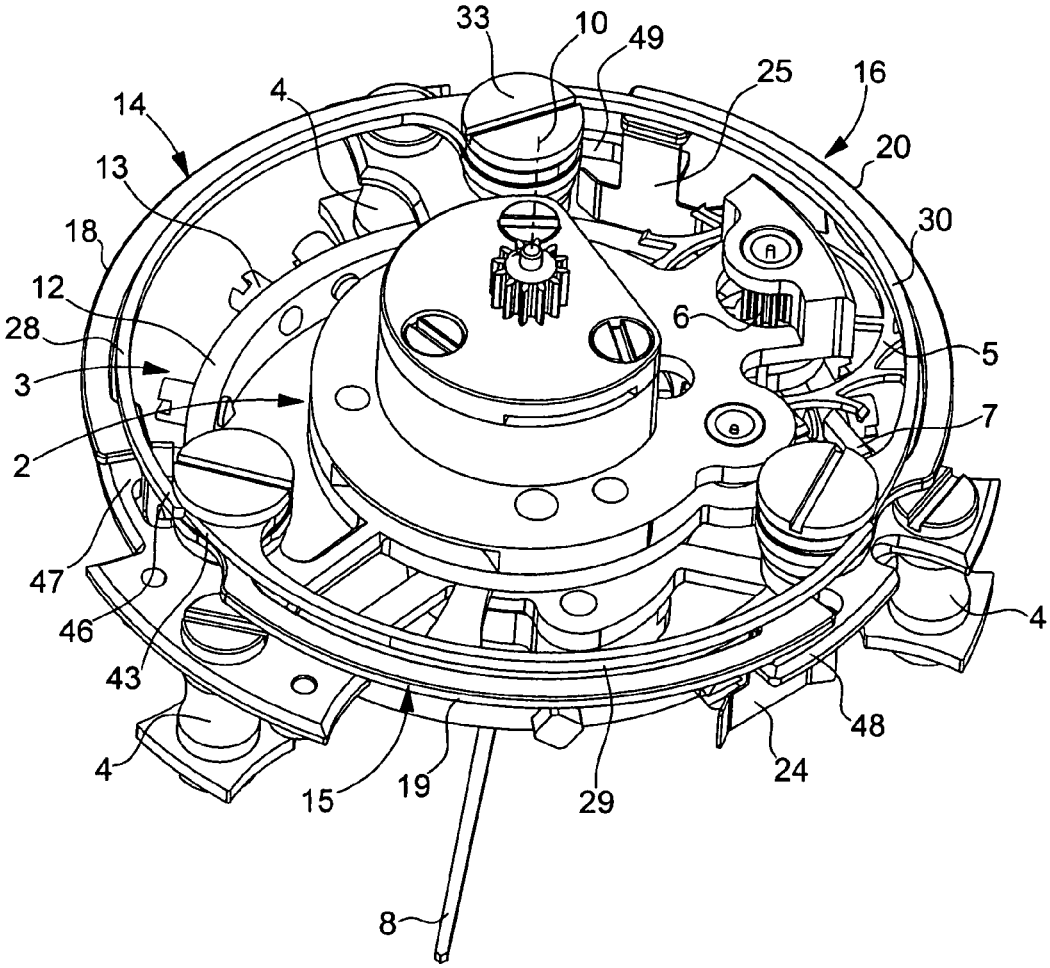
FIG. 2 is a perspective view of the tourbillon of FIG. 1 showing the device when assembled.

Tourbillon 1 shown in FIGS. 1 and 2 comprises in a conventional manner a rotating carriage 2 with three pillars 4. Inside the carriage there is the balance 3 associated with a balance spring and the escapement members, particularly the escapement wheel 5, the escapement pinion 6 and the pallets 7. A second hand is shown at 8. Balance 3 oscillates in rotation inside carriage 2 about the rotational axis 10 of the carriage. The periphery of balance 3 comprises a felloe 12 provided with screws 13. FIGS. 1 to 4 show that the manually controlled means act on the periphery of balance 3 in order to block said balance, these means consisting, not in implementing a mobile spring with two arms outside the tourbillon carriage as in the aforecited DE document No. 101 60 287, but in using mobile elements 14, 15 and 16 mounted on carriage 2 and capable of entering into contact with the periphery of balance 3 in order to block it when action is exerted on at least one of said mobile elements by an element 17, in this case a sliding shoe, arranged outside carriage 2 and manually controlled.

We will now examine a way of making the mobile elements discussed hereinbefore and how the person wearing the watch can manually control these mobile elements.

Figure 4:
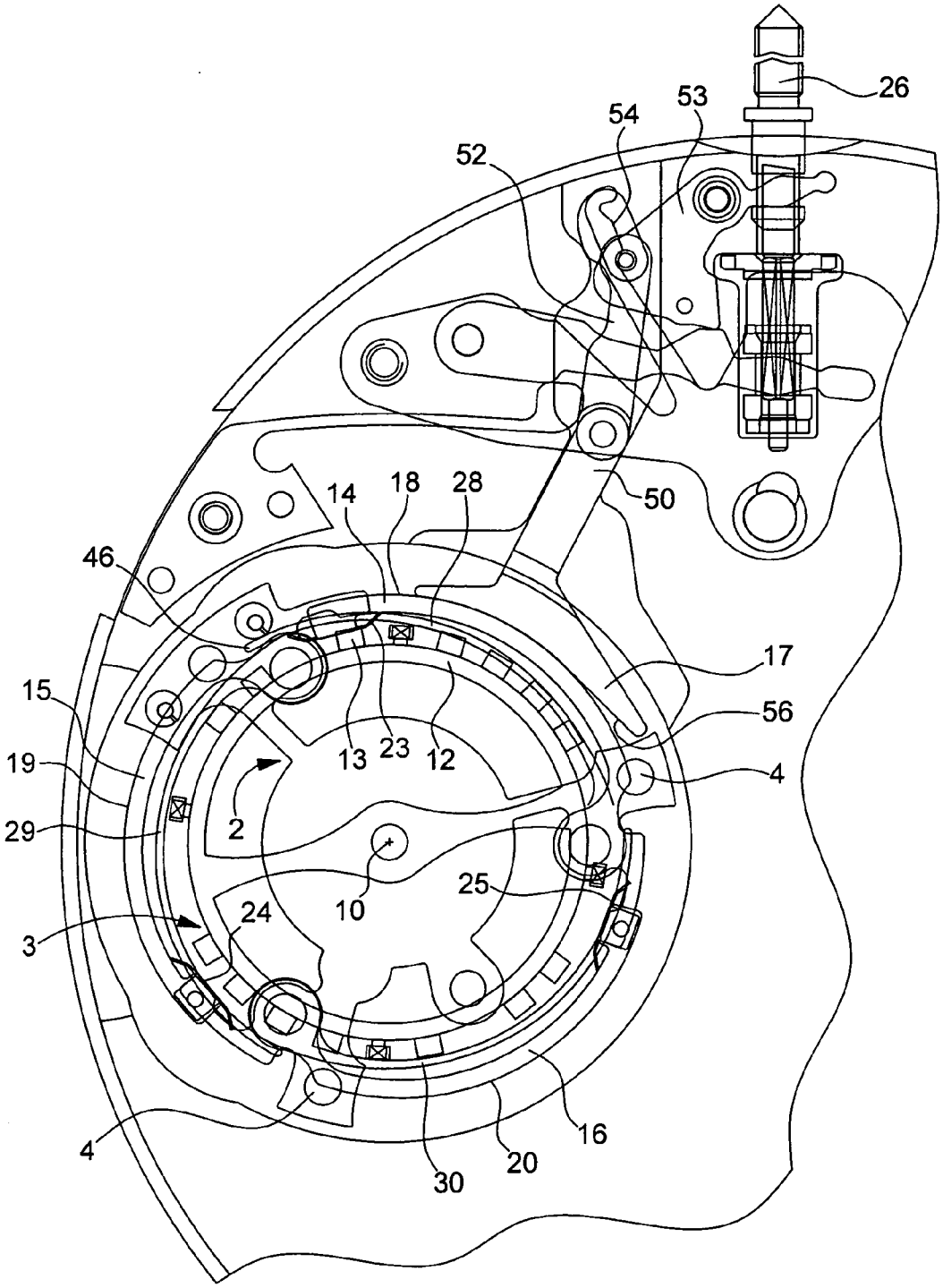
FIG. 4 is a plan view of a part of the watch fitted with the tourbillon of the invention, said Figure showing the control stem in a time setting pulled-out position

With particular reference to FIG. 1, which shows tourbillon 1 one part of which is exploded, it can be seen that each of said mobile elements is a lever 14, 15 and 16 mounted on carriage 2. Each lever 14, 15 and 16 has an outer edge 18, 19 and 20 in the form of an arc of a circle substantially centred on rotational axis 10 of carriage 2. The first end 21 of each lever is pivotably mounted on the carriage and its second end 22 carries a pad 23, 24 and 25 capable of blocking balance 3. As can be seen in FIG. 4, blocking occurs when shoe 17, controlled by a time-setting stem 26, exerts pressure on lever 14 and more generally on at least one of levers 14, 15 and 16. FIGS. 1 and 4 also show that each of these levers is returned by a return spring 28, 29 and 30 mounted on carriage 2, when shoe 17 stops exerting pressure on the lever.

The embodiment shown in the Figures comprises three levers 14, 15 and 16 mounted on carriage 2 and surrounding the whole of the carriage. In order to do this, in a peripheral zone of said carriage 2 there are secured three screw pins 32, distributed at an equal distance from each other and only one of which is visible in FIG. 1, the others being concealed by a screw head 33 of large dimensions screwed into the screw pin. On each of the screw pins there is a pivotably mounted socket 35, 36 and 37. As can be seen clearly in FIG. 1, driven onto the socket there is a first ring 38, 39 and 40 forming the first end 21 of lever 14, 15 and 16 and a second ring 42, 43 and 44 forming a first end 45 of the respective return spring 28, 29 and 30. FIG. 2 shows that the second end 46 of return spring 28 abuts against an element supported by the carriage, in this case the second return spring 29 and 30. The same is valid for return springs 29 and 30. Thus, for example, when shoe 17 exerts pressure on lever 14 (a situation shown in FIG. 4), return spring 28 tightens and its second end 46 slides onto ring 43 of return spring 29.

It will be mentioned here that in the embodiment shown in the Figures, the rest position of each of levers 14, 15 and 16 is defined by a stop 47, 48 and 49 which forms parts of carriage 2, as seen in FIGS. 1 and 2. It can be seen that pad 23, 24 and 25 of lever 14, 15 and 16 will abut against this stop.

Figure 3:
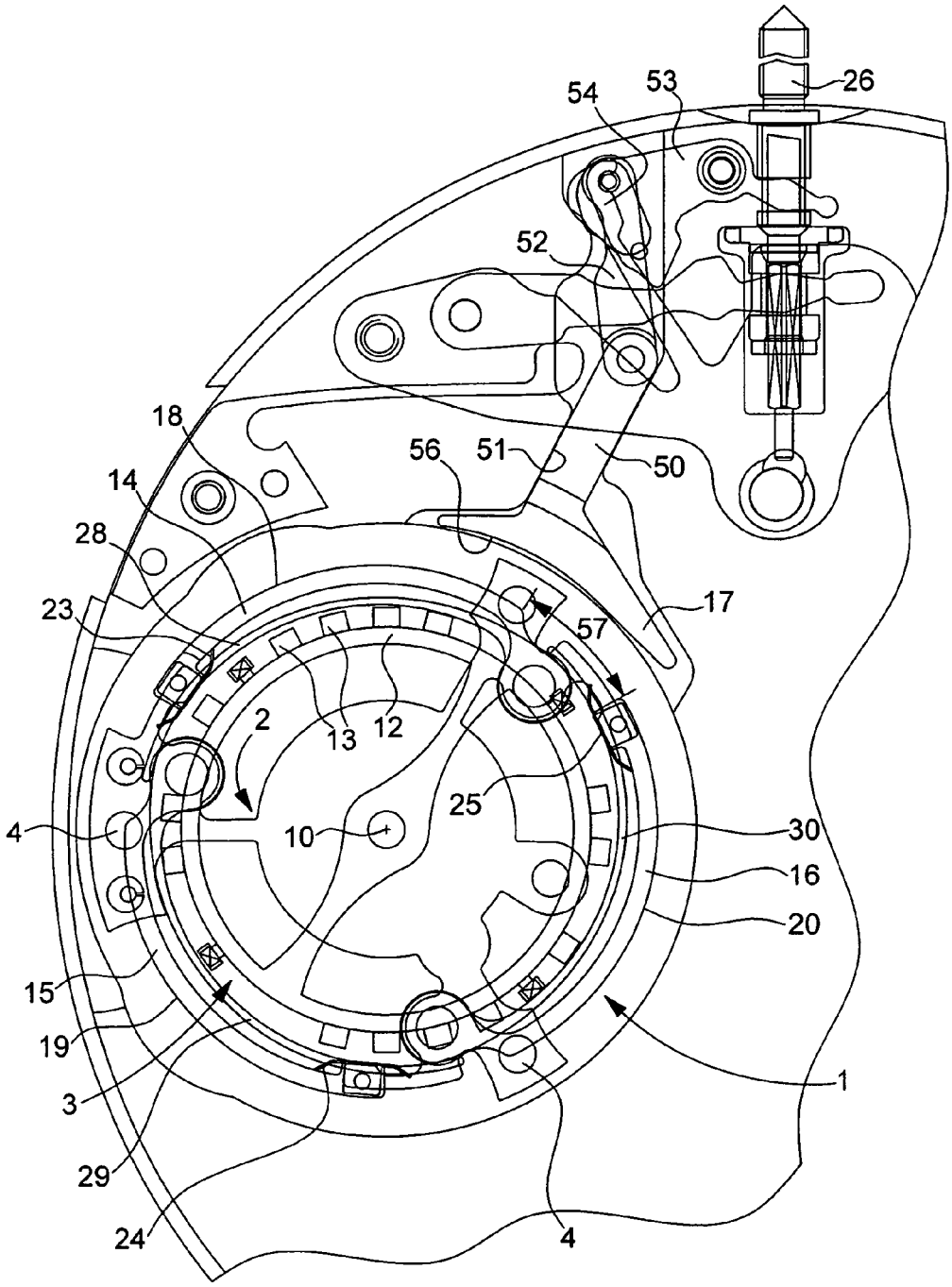
FIG. 3 is a plan view of a part of the watch fitted with the tourbillon of the invention, said Figure showing the control stem in a pushed-in position.

We will now explain how shoe 17 is controlled from time-setting stem 26. FIGS. 3 and 4 are plan views of a part of the watch in which tourbillon 1 is mounted. It was explained hereinbefore how balance 3 fitted to the tourbillon can be blocked by shoe 17. As FIGS. 3 and 4 show, this shoe 17 is provided with a tail 50 able to slide into a recess 51 comprised in the watch plate. The end of tail 50 is attached to a connecting rod 52 controlled by a pull-out piece 53, which is in turn controlled by time-setting stem 26. Pull-out piece 53 acts on a jumper spring 54, which indexes the pushed-in and pulled-out positions of stem 26.

FIG. 3 shows stem 26 in the pushed-in position. This is the rest position in which the watch can be wound. In this position, shoe 17 is set apart from tourbillon 1 and the balance thereof.

FIG. 4 shows stem 26 in the pulled-out position. This is the time-setting position of the watch, in which the hour and minute hands can be adjusted by rotating a crown that caps stem 26 on the exterior of the watchcase. When stem 26 is pulled out, shoe 17 is moved in the direction of the tourbillon and exerts pressure on at least one of levers 14, 15 and 16, in this example on lever 14. Pad 23 mounted on lever 14 momentarily blocks balance 3 via friction abutting radially against an element of the balance, in this case against one of screws 13 mounted on felloe 12. This pad could abut against felloe 12 in certain cases.

It will be noted that the outer edges 18, 19 and 20 of levers 14, 15 and 16 are located above pillars 4 of carriage 2 (see FIGS. 1 and 2). In this manner, shoe 17 can act on said levers without interfering with the carriage pillars, which, as seen hereinbefore, move at a rate of one revolution per minute. It will also be noted that pads 23, 24 and 25 have a certain elasticity such that the balance, when stopped, is not excessively stressed. It will be noted finally that shoe 17 has, opposite outer edges 18, 19 and 20 of the levers, a concave face 56 arranged for abutting against said outer edges. This concave face is of longer length than the gap 57 (FIG. 3) that separates the outer edges of two successive levers. In this manner, concave face 56 of shoe 17 can act on one or two levers, whatever the angular position of the tourbillon carriage.

The description that has just been given of the stop device according to the present invention clearly shows that this is a highly technical embodiment implementing solutions that are perfectly suited to top of the range horology. Indeed, the wire spring or strip spring acting directly on the balance has been avoided; thereby avoiding the drawbacks associated therewith and which were listed in the preamble to this description.

What is claimed is:

1. A device for stopping a watch-movement during time-setting, said watch movement being part of a watch and comprising a tourbillon, said tourbillon comprising a rotating carriage inside which a balance oscillates about a rotational axis of the carriage, said device including manually controlled blocking means for stopping said balance by acting on a peripheral zone of said balance, wherein said blocking means include mobile elements mounted on the carriage and capable of entering into contact with the periphery of said balance in order to block said balance when action is exerted on at least one of said mobile elements by an element that is arranged outside the carriage and controlled manually from the exterior of said watch.

2. A stop device for the set-hands mechanism of a watch fitted with a tourbillon, said tourbillon comprising a rotating carriage inside which a balance oscillates about a rotational axis of the carriage, said device including manually controlled means for blocking the balance in its peripheral zone, wherein said blocking means include mobile elements mounted on the carriage and capable of contacting the periphery of the balance in order to block the latter when action is exerted on at least one of said mobile elements by an element that is arranged outside the carriage and controlled manually, and wherein each of said mobile elements is a lever, the first end of which is pivotably mounted on the carriage and the second end of which carries a pad capable of blocking the balance when a shoe, controlled by a time-setting stem, exerts a pressure on the lever, each of said levers being returned to a rest position by a return spring.

3. The device of claim 2, wherein three fixed pins are distributed at equal distances from each other in a peripheral zone of the carriage and wherein, on each of said pins, a socket is pivotably mounted onto which are driven a first ring forming the first end of the lever and a second ring forming a first end of the return spring, the second end of said return spring resting on the second ring of the next return spring.

4. The device of claim 2, wherein each lever has an outer edge in the shape of an arc of a circle substantially centred on the rotational axis of the carriage.

5. The device of claim 4, wherein said outer edges of the levers are located above pillars of the carriage.

6. The device of claim 2, wherein, facing the outer edges of the levers, the shoe has a concave face arranged to abut against said outer edges and having a greater length than any gap separating two successive levers.

7. The device of claim 2, wherein the rest position of each of said levers is defined by a stop member forming part of the carriage, the pad of the lever abutting against said stop member.

8. The device of claim 2, wherein the shoe is provided with a tail that slides in a recess comprised in the plate of the watch, an the end of said tail being attached to a connecting rod controlled by a pull-out piece controlled by the time setting stem, said pull-out piece acting on a jumper spring to index the pushed-in and pulled-out positions of the stem.

* * * * *